US010991482B2

(12) United States Patent
Yoshino et al.

(10) Patent No.: US 10,991,482 B2
(45) Date of Patent: Apr. 27, 2021

(54) CABLE

(71) Applicant: SONY CORPORATION, Tokyo (JP)

(72) Inventors: Yoshitaka Yoshino, Tokyo (JP); Toshiyuki Sudo, Tokyo (JP); Makoto Makishima, Kanagawa (JP); Nao Maeda, Tokyo (JP)

(73) Assignee: SONY SEMICONDUCTOR SOLUTIONS CORPORATION, Kanagawa (JP)

( * ) Notice: Subject to any disclaimer, the term of this patent is extended or adjusted under 35 U.S.C. 154(b) by 218 days.

(21) Appl. No.: 16/073,313

(22) PCT Filed: Dec. 9, 2016

(86) PCT No.: PCT/JP2016/005089
§ 371 (c)(1),
(2) Date: Jul. 26, 2018

(87) PCT Pub. No.: WO2017/141295
PCT Pub. Date: Aug. 24, 2017

(65) Prior Publication Data

US 2019/0066870 A1 Feb. 28, 2019

(30) Foreign Application Priority Data

Feb. 15, 2016 (JP) ..... 2016-025532
Jul. 13, 2016 (JP) ..... 2016-138461
Sep. 30, 2016 (JP) ..... JP2016-194601

(51) Int. Cl.
*H01B 7/00* (2006.01)
*H01B 7/04* (2006.01)
(Continued)

(52) U.S. Cl.
CPC ..... *H01B 7/04* (2013.01); *H01B 7/0009* (2013.01); *H01B 7/02* (2013.01); *H01B 7/1825* (2013.01);
(Continued)

(58) Field of Classification Search
CPC ..... H01B 7/04; H01B 7/0009; H01B 7/02; H01B 7/1825; H01B 7/221; H01B 7/40;
(Continued)

(56) References Cited

U.S. PATENT DOCUMENTS 4,707,569 A * 11/1987 Yoshimura ..... H01B 7/1895 174/110 F
6,300,573 B1 * 10/2001 Horie ..... H01B 7/1895 174/113 C
(Continued)

FOREIGN PATENT DOCUMENTS

CN 102163765 A 8/2011
CN 202150291 U 2/2012
(Continued)

OTHER PUBLICATIONS

Office Action for CN Patent Application No. 201680081326.9, dated Aug. 20, 2019, 05 pages of Office Action and 08 pages of English Translation.
(Continued)

*Primary Examiner* — Angel R Estrada
(74) *Attorney, Agent, or Firm* — Chip Law Group

(57) ABSTRACT

A cable includes a line for signal transmission or power source supply, a first metal wire having flexibility and a shape-retaining property, a plurality of yarns extending substantially in the same direction as that of the first metal wire, and a coating material for coating the line, the first metal wire, and the plurality of yarns.

19 Claims, 14 Drawing Sheets

(51) Int. Cl.

| | |
|---|---|
| ***H01B 7/22*** | (2006.01) |
| ***H01R 24/58*** | (2011.01) |
| ***H01B 7/18*** | (2006.01) |
| ***H01B 7/02*** | (2006.01) |
| ***H01B 11/18*** | (2006.01) |
| *H01R 13/639* | (2006.01) |
| *H01B 7/40* | (2006.01) |

(52) U.S. Cl.
CPC ..... *H01B 7/221* (2013.01); *H01B 11/1813* (2013.01); *H01B 11/1834* (2013.01); *H01R 24/58* (2013.01); *H01B 7/40* (2013.01); *H01R 13/6392* (2013.01)

(58) Field of Classification Search
CPC .. H01B 11/1813; H01B 11/1834; H01B 7/00; H01R 24/58; H01R 13/6392
USPC ..... 174/68.1, 260, 110 R, 36, 32, 113 R, 174/117 R
See application file for complete search history.

(56) References Cited

U.S. PATENT DOCUMENTS

| | | | | |
|---|---|---|---|---|
| 7,297,873 | B2 * | 11/2007 | Grogl | H01B 7/292 174/121 A |
| 7,763,802 | B2 * | 7/2010 | Varkey | H01B 7/046 174/106 R |
| 8,487,186 | B2 * | 7/2013 | Walid | H01B 7/288 174/110 R |
| 8,981,216 | B2 * | 3/2015 | Grant | H01B 11/06 174/113 R |
| 9,018,529 | B2 * | 4/2015 | Sidlyarevich | H01B 7/04 174/110 R |
| 2015/0055020 | A1 | 2/2015 | Yoshino et al. | |
| 2016/0265093 | A1 | 9/2016 | Ueland et al. | |

FOREIGN PATENT DOCUMENTS

| | | | |
|---|---|---|---|
| CN | 104115409 | A | 10/2014 |
| CN | 203983628 | U | 12/2014 |
| EP | 2819311 | A1 | 12/2014 |
| EP | 3063308 | A1 | 9/2016 |
| JP | 09-092038 | A | 4/1997 |
| JP | 2003-207701 | | 7/2003 |
| JP | 2003-207701 | A | 7/2003 |
| JP | 2011-172125 | A | 9/2011 |
| JP | 2012-204887 | A | 10/2012 |
| JP | 2013-201750 | A | 10/2013 |
| JP | 2016-539488 | A | 12/2016 |
| KR | 10-2004-0104942 | A | 12/2004 |
| KR | 10-2014-0125767 | A | 10/2014 |
| TW | 201349760 | A | 12/2013 |
| WO | 2013/125347 | A1 | 8/2013 |
| WO | 2015/066603 | A1 | 5/2015 |

OTHER PUBLICATIONS

International Search Report and Written Opinion of PCT Application No. PCT/JP2016/005089, dated Jan. 10, 2017, 09 pages of ISRWO.

Office Action for IN Patent Application No. 201817029808, dated Sep. 2, 2020, 05 pages of Office Action.

* cited by examiner

CABLE

CROSS REFERENCE TO RELATED APPLICATIONS

This application is a U.S. National Phase of International Patent Application No. PCT/JP2016/005089 filed on Dec. 9, 2016, which claims priority benefit of Japanese Patent Application Numbers JP 2016-025532 filed on Feb. 15, 2016, JP 2016-138461 filed on Jul. 13, 2016, and JP 2016-194601 filed on Sep. 30, 2016 in the Japan Patent Office. Each of the above-referenced applications is hereby incorporated herein by reference in its entirety.

TECHNICAL FIELD

The present technique relates to a cable having a shape-retaining function.

BACKGROUND ART

There is known a flexible cable with a shape-retaining function in which a metal wire used in a supporting portion of a desk lamp, a lighting stand or the like is wound in a cable shape. In this sort of cable, the metal wire is formed in a cable shape. Therefore, this sort of cable involves a problem that the cable is expensive, the cable is heavy in weight, and coloring of the cable and the printing on the cable are difficult to carry out, and the cable is also poor in flexibility.

PTL 1 describes a LAN cable, with a shape-retaining function, which includes a cable core and a sheath including a synthetic resin and coating the cable core, and in which a plurality of metal wires for shape memory are disposed in the sheath. The metal wires for shape memory are disposed so as not to be in close contact with the sheath, but so as to be able to be axially displaced.

CITATION LIST

Patent Literature

[PTL 1]
JP 1997-92038A

SUMMARY

Technical Problems

The construction of PTL 1 involves a problem that since the sheath filled with the synthetic resin is used, the weight is increased. In addition, it is feared that when the cable is bent at a large angle, the buckling is caused. Moreover, there is also known a construction of a light at hand of a personal computer in which a metal wire and a USB (Universal Serial Bus) cable are put in a sheath including a synthetic resin, and an LED (Light Emitting Diode) lamp is connected to one end of the sheath. In this construction, since the USB cable and the metal wire are coated with the sheath, when the cable is held, the hard feeling is offered. In addition, because of a flat shape responding to the shape of a USB connector, it is difficult to form a cable having a circular shape in cross section suitable for being connected to a circular connector.

Moreover, a magnifying glass is put into practical use. In the magnifying glass, a dummy plug including a resin or the like and having the same shape as that of a plug is inserted into a jack of a smartphone, a rod is mounted to the dummy plug, and a screen of the smartphone can be viewed by a lens at a head of the rod in a magnifying scale. In such a magnifying glass, it is feared that the magnifying glass is independent of a signal transmission use application, and the dummy plug including a resin which is different from the original plug is inserted into the jack, thereby causing the deterioration such as the contact failure of the jack portion.

Therefore, it is an object of the present technique to provide a cable which is capable of solving these problems.

Solution to Problems

The present technique is a cable provided with a line for signal transmission or power source supply, a first metal wire having flexibility and a shape-retaining property, a plurality of yarns extending substantially in the same direction as that of the first metal wire, and a coating material for coating the line, the first metal wire and the plurality of yarns.

Advantageous Effects of Invention

According to at least one embodiment, one cable can have both the function for the signal transmission or the power source supply, and the function as a stand. Moreover, the cable can be colored or a pattern can be printed on the cable. It should be noted that the effects described here are not necessarily limited, and any of the effects described in the present technique may be offered. In addition, the content of the present technique is not intended to be interpreted in a limiting sense by exemplified effects in the following description.

DESCRIPTION OF EMBODIMENTS

Embodiments which will be described below are suitable concrete examples of the present technique, and technically preferable various limitations are added thereto. However, the scope of the present technique is not limited to these embodiments unless there is especially a description given the effect that the present technique is limited.

It should be noted that the description of the present technique will be given in accordance with the following order.

<1. First Embodiment>
<2. Second Embodiment>
<3. Third Embodiment>
<4. Fourth Embodiment>
<5. Fifth Embodiment>
<6. Modified Changes>

1. First Embodiment

"Use State"

In the case where a program of television broadcasting is received or recorded by using a smartphone, or an image on the Internet is browsed, and so forth, at present, a user views a screen with the smartphone being held by his/her hand. On the other hand, in the home, it is convenient that the user can view the screen with the smartphone being placed on a desk or the like, and a dedicated stand for this situation is attached or marketed. An earphone cable with an antenna is known as an antenna used in the case where the television broadcasting is viewed. However, for the purpose of viewing the television broadcasting with the smartphone being placed on the stand, since the stand itself needs to be carried, this is lacked in convenience.

Figure 1:
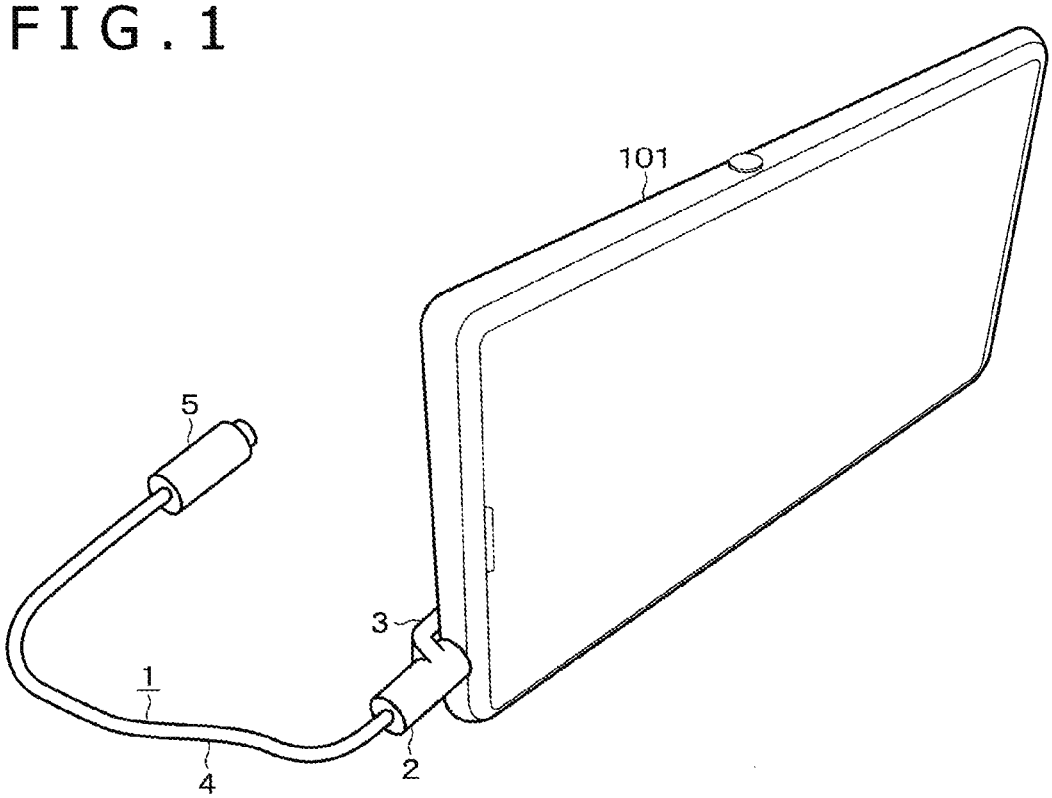
FIG. 1 is a perspective view used for a description of a use state of a first embodiment.

As depicted in FIG. 1, an earphone cable 1 with an antenna to which the present technique is applied has a shape-retaining function. Therefore, when the earphone cable 1 with the antenna is connected to a smartphone 101, even if a stand or a holder as a separate body is not used, the smartphone 101 can be put upright. The smartphone 101 has a display portion including a display system circuit, a liquid crystal display device, and the like, and a manipulation portion with which key-in and the like are carried out. Hereinafter, a description will be given with respect to the earphone cable 1 with the antenna having the function as the stand, that is, the shape-retaining function.

The earphone cable 1 with the antenna has a plug, for example, a 4-pole plug 2 which is connected to a jack for earphone connection of the smartphone 101, for example, having a television tuner built therein, for example, a 4-pole jack, a coaxial cable 4 connected to the 4-pole plug 2, and a 4-pole jack 5. A detent 3 is integrally formed in the 4-pole plug 2 through resin molding. An earphone cable (not depicted) is connected to the 4-pole jack 5, so that the sound is listened to by using the earphone. It should be noted that instead of using the 4-pole plug and the 4-pole jack, a 3-pole plug and a 3-pole jack may be used.

Figure 2:
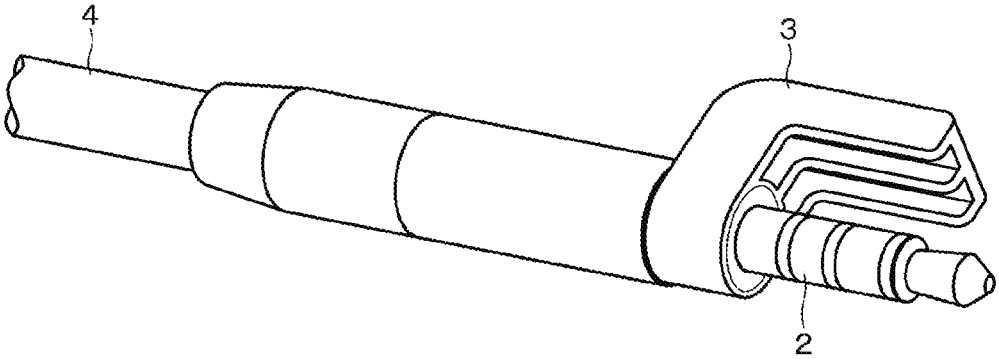
FIG. 2 is a perspective view for explaining an example of a detent provided in a plug of a cable.
Figure 3:
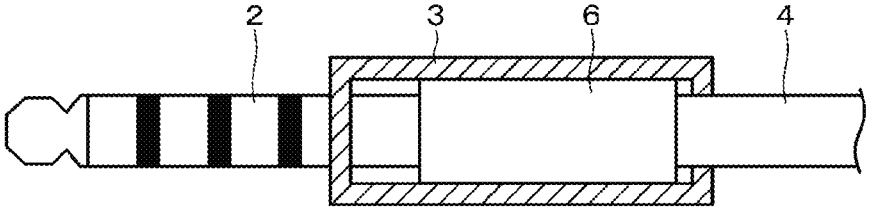
FIG. 3 is a partially cross-sectional view for explaining an example of the detent provided in the plug of the cable.

The detent 3, as depicted in a magnified form in FIG. 2, has an L-letter shaped elastic piece which is formed integrally with a cover of the 4-pole plug 2. When the 4-pole plug 2 is inserted into the jack of the smartphone 101, the elastic piece is located on a back surface (or a front surface) side of the smartphone 101, thereby blocking the smartphone 101 from being rotated. The detent 3 may have another shape. In the case where the detent 3 is formed, as depicted in FIG. 3, after a wire rod is soldered to the 4-pole plug 2 having a diameter of 3.5 mm, a cover 6 is formed through primary molding, and next, the secondary molding of the detent 3 is carried out so as to cover the cover 6.

Figure 4:
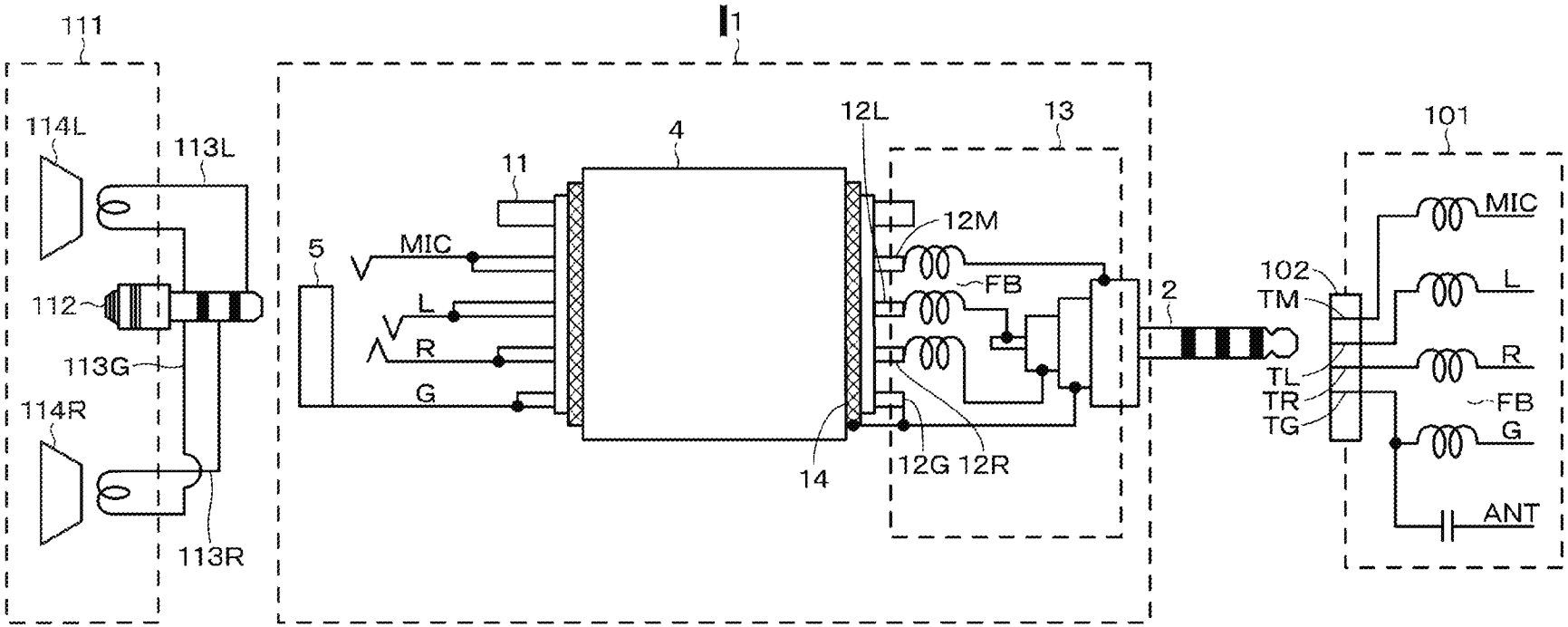
FIG. 4 is a connection diagram depicting a reception system including an earphone cable with an antenna according to the first embodiment of the present technique.

A description will now be given with respect to electrical connection of the earphone cable 1 with the antenna with reference to FIG. 4. The smartphone 101 has a circular 4-pole jack 102 for connection of an earphone and a microphone. The 4-pole jack 102 has an electrode TL, an electrode TR, an electrode TM, and an electrode TG. In this case, the electrode TL is connected to a chip (L-channel terminal) of a circular 4-pole plug 2 of the earphone cable 1 with the antenna. The electrode TR is connected to a ring (R-channel terminal) of the 4-pole plug 2. The electrode TM is connected to a ring (microphone terminal) of the 4-pole plug 2. In addition, the electrode TG is connected to a sleeve (ground terminal) of the 4-pole plug 2.

A signal line (L) of an audio L-channel is drawn from the electrode TL through a ferrite bead FB. A signal line (R) of an audio R-channel is drawn from the electrode TR through the ferrite bead FB. The electrode TG is drawn as a ground line (G) for audio through the ferrite bead FB, and is drawn as an antenna signal line (ANT) through a capacitor. Although not illustrated, the antenna signal line is connected to a receiving device (tuner) within the smartphone 101. Moreover, a line for a microphone (MIC) is drawn to the electrode TM through the ferrite bead FB. The ferrite bead FB is connected for the purpose of cutting off the high frequency components. Instead of using the ferrite bead FB, a coil may be used as long as all it takes is that a mechanism for cutting off the high frequency components is provided in addition thereto.

The earphone cable 1 with the antenna has a coaxial cable 4 connected to the 4-pole plug 2. A length of the coaxial cable 4, for example, is 100 mm. A line 12L for audio signal transmission of the L-channel, a line 12R for audio signal transmission of the R-channel, a ground line 12G, and a microphone cable 12M are included in the coaxial cable 4.

The lines of the coaxial cable 4 are connected to respective electrodes protruding to the rear side of the 4-pole plug 2 via a relay portion 13 through the ferrite bead FB having a function of cutting off the high frequency components. The relay portion 13, for example, is formed on a substrate or through the molding. Instead of the ferrite bead FB, a coil may be connected. Moreover, instead of the relay portion 13 and the ferrite bead FB, a ferrite core may be used. The ferrite bead FB is mounted for cutting-off the high frequency components in such a way that the ferrite bead FB has low impedance in the audio frequency band, and has high impedance in a high frequency band, for example, a VHF frequency band or higher. Instead of the ferrite bead FB, a coil may be used as long as all it takes is that a mechanism for cutting off the high frequency components is provided in addition thereto.

The coaxial cable 4 is provided with a shielded wire 14 having a structure of a braided copper wire. The shielded wire 14 of the coaxial cable 4 functions as a monopole antenna. The length of the coaxial cable 4 is set to approximately $\lambda/4$ ($\lambda$: wavelength of received frequency). Moreover, as will be described later, for the shape-retaining function of the coaxial cable 4, a metal wire 11 is disposed inside the coaxial cable 4. A circular 4-pole jack 5 is connected to the other end of the coaxial cable 4.

An earphone portion 111 has a configuration in which earphones 114L and 114R are connected to a circular 4-pole plug 112 connected to the 4-pole jack 5 through earphone cables 113L and 113R. An earphone cable 113G is a ground line common to the left and right channels. The 4-pole jack 5 and the 4-pole plug 112, for example, are each 3.5 mm in diameter, and can be connected to the 4-pole jack 102 as well of the smartphone 101.

Figure 5:
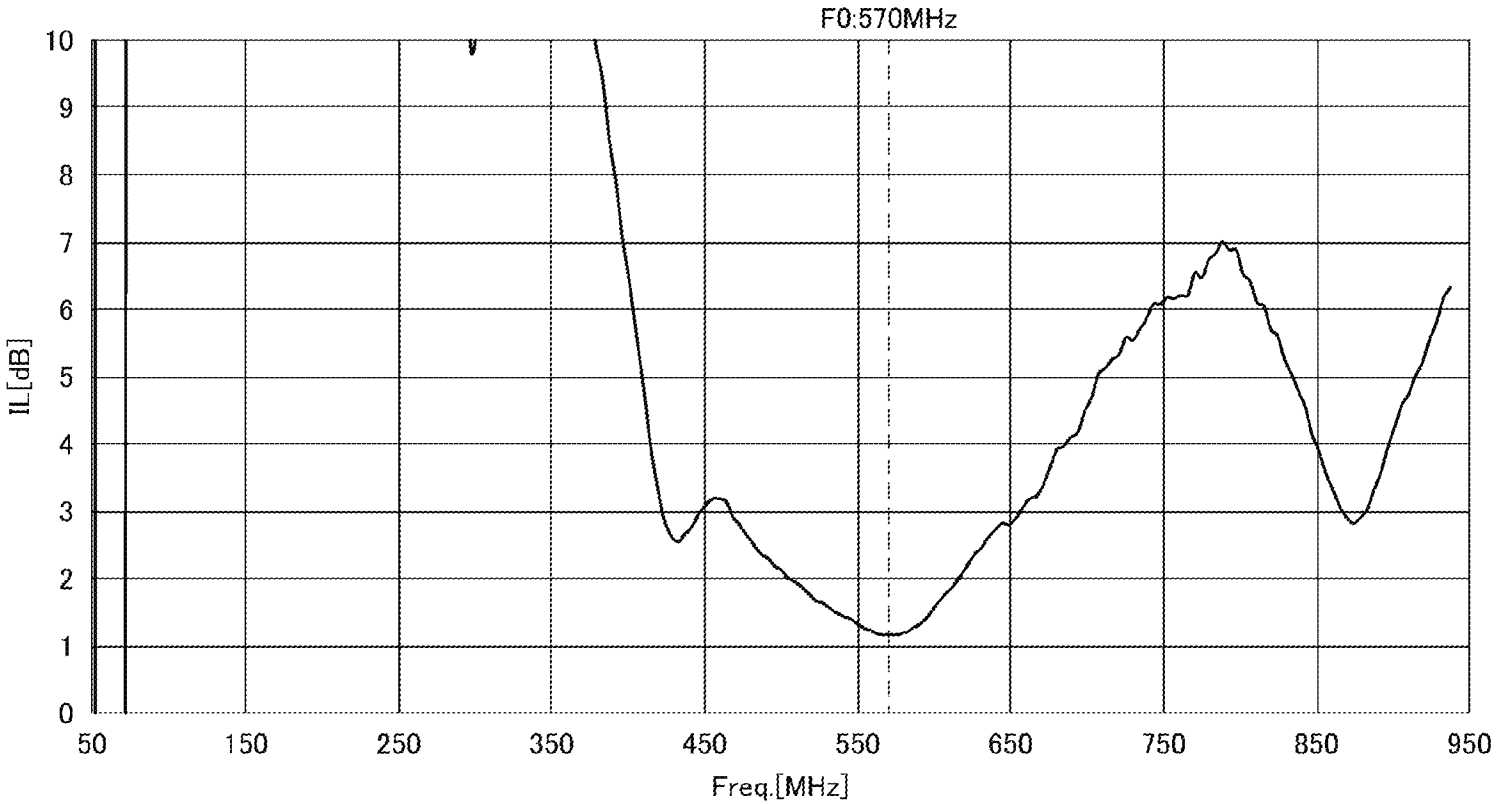
FIG. 5 is a graphical representation used for explaining frequency characteristics in the first embodiment of the present technique.

FIG. 5 depicts a result of measurement of a VSWR (Voltage Standing Wave Ratio) in the first embodiment. An axis of abscissa of FIG. 5 represents a frequency, and an axis of ordinate represents a value of a reflection loss. As depicted in FIG. 5, for example, the reflection loss is small in the vicinity of 570 MHz.

Figure 6:
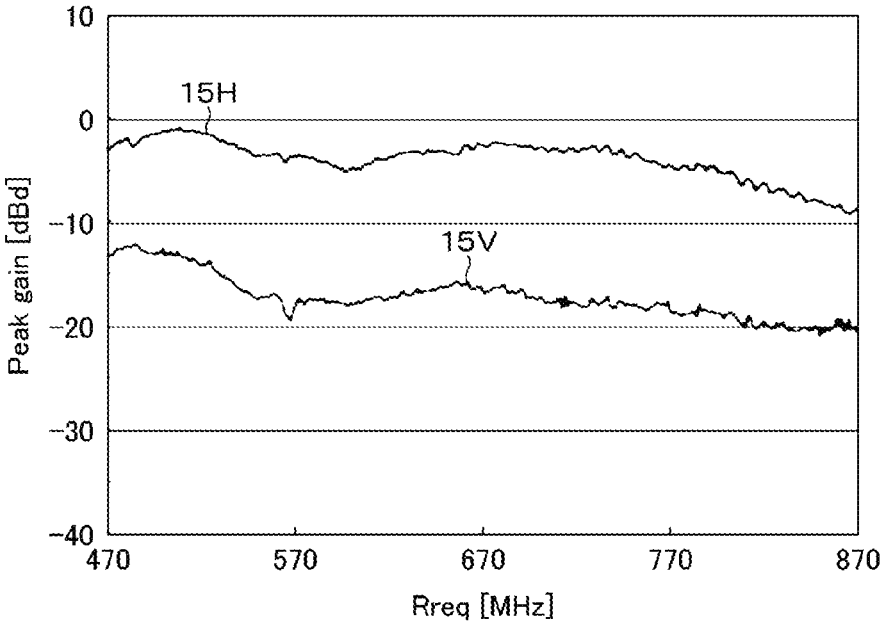
FIG. 6 is a graphical representation depicting peak gain characteristics with respect to a frequency in the first embodiment.

FIG. 6 is a graph representing peak gain characteristics with respect to a frequency in the first embodiment. The peak gain is a relative gain with respect to a gain of a dipole antenna. A curve 15H depicted in FIG. 6 represents characteristics of a horizontally polarized wave, and a curve 15V represents characteristics of a vertically polarized wave. FIG. 6 depicts the characteristics of a single body of the earphone cable 1 with the antenna. The details of the measurement results are depicted in Table 1 and Table 2.

TABLE 1

| Vretical polaization | | | | | | | | |
|---|---|---|---|---|---|---|---|---|
| Freq [MHz] | 470 | 520 | 570 | 620 | 670 | 720 | 770 | 906 |
| Peak [dBd] | −13.16 | −14.06 | −17.83 | −17.26 | −16.67 | −17.83 | −18.70 | −20.95 |

TABLE 2

| Horizontal polaization | | | | | | | | |
|---|---|---|---|---|---|---|---|---|
| Freq [MHz] | 470 | 520 | 570 | 620 | 670 | 720 | 770 | 906 |
| Peak [dBd] | −2.96 | −1.46 | −3.62 | −3.73 | −2.63 | −3.23 | −4.50 | −7.20 |

Figure 7:
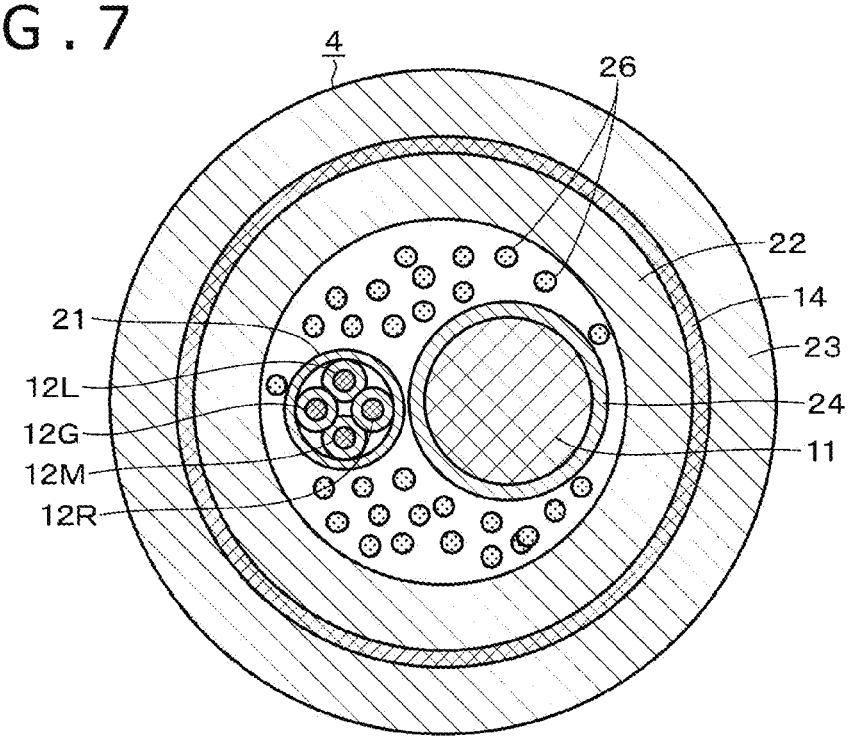
FIG. 7 is a cross-sectional view used in a description of the cable according to the first embodiment of the present technique.

FIG. 7 is a cross-sectional view when the coaxial cable 4 is cut vertically with respect to a longitudinal direction. The coaxial cable 4 has a line 12L for audio signal transmission of the L-channel, a line 12R for audio signal transmission of the R-channel, a ground line 12G, and a microphone cable 12M. These transmission lines 12L, 12R, 12G and 12M are each coated with coating materials for insulation, for example, polyurethane.

Moreover, the four lines for audio signal transmission are bundled with a coating material. The coating material is a metal foil including aluminum or the like, a resin, a resin mixed with a magnetic material such as ferrite, paper or the like. The lines for the audio signal transmission which are bundled with the coating material are suitably referred to as a signal line 21. When a synthetic resin mixed with powder of ferrite is used as the coating material, an electric wave absorbing portion is interposed between the shielded wire 14 and the signal line 21, and the isolation between the shielded wire 14 and the signal line 21 can be secured. As a result, the characteristics of the shielded wire 14 as the antenna can be made satisfactory.

In the shielded wire 14, an outer insulating coating 23 is further provided on the shielded wire 14 including a braided copper wire provided on an inner insulating coating 22. A metal wire 11 coated with a resin 24, and a cotton yarn 26 are coated together with the signal line 21 with the inner insulating coating 22. The metal wire 11 has such flexibility as to enable a shape to be freely changed, and has such a shape-retaining property that the metal wire 11 functions as the stand of the smartphone 101. The metal wire 11 is a wire rod which, for example, includes a metal such as copper, iron, stainless, or a combination thereof, and has a diameter of 0.5 mm or more. A thickness of the resin 24, for example, is set to 0.25 mm. However, it is not essential that the metal wire 11 is coated with the resin 24. As an example, an annealed copper wire of 1.0 mm is used. The diameter and material quality of the metal wire 11 is suitably set in consideration of a weight of an electronic apparatus supported by the metal wire 11.

Figure 8:
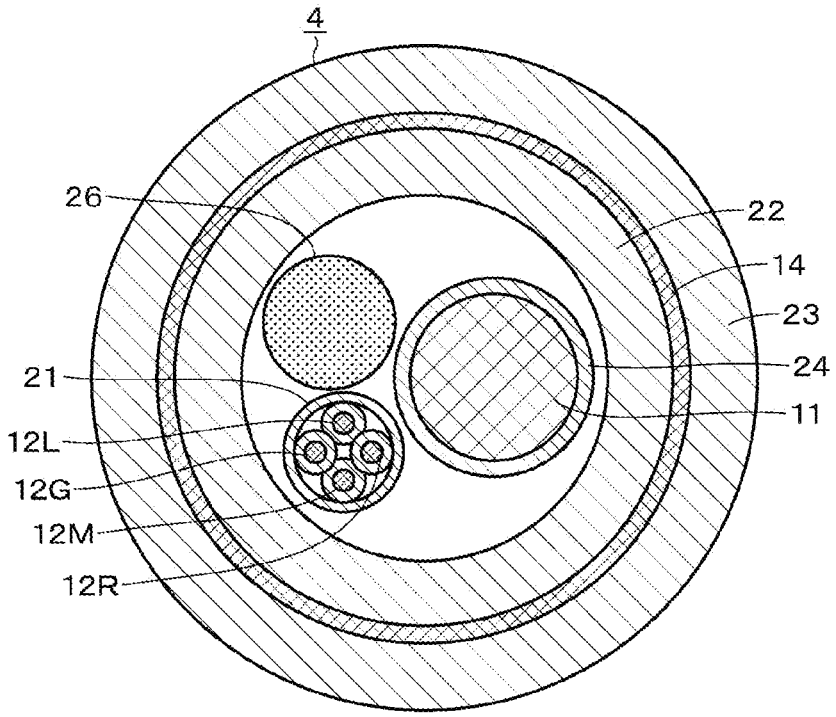
FIG. 8 is a cross-sectional view used in a description at the time of manufacture of the cable according to the first embodiment of the present technique.
Figure 9:
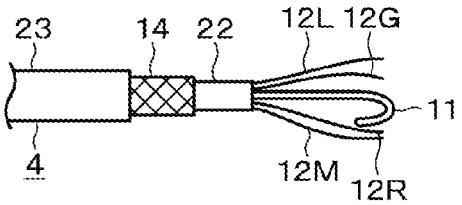
FIG. 9 is a schematic diagram used in a description of a retainer of a metal wire.

In addition to the cotton yarn 26, an insulating yarn such as a yarn of a chemical fiber including aramid, nylon, rayon or the like may be used. The cotton yarn 26 is advantageous in terms of cost, easy to be available, and easy in processing such as cutting. Since the yarns have a form of twisted yarns obtained by twisting a plurality of yarns, at the time of manufacture, as depicted in FIG. 8, the yarns are present in a state in which a plurality of yarns are bundled by the inner insulating coating 22. After the manufacture, or after the coaxial cable 4 is used for a certain period of time, the cotton yarns 26 get loose in the inside to become a state in which the cotton yarns 26 are present in a substantially uniformly dispersed manner as depicted in FIG. 7. As far as the twisted yarns, the twisted yarns obtained by bundling approximately 2 to 4 yarns twisted, or one twisted yarn obtained by bundling more yarns can be used. The cotton yarns 26 having a length substantially equal to a total length of the coaxial cable 4 can be used. However, the cotton yarn 26 which is divided into parts each having a shorter length may be used. It should be noted that for the purpose of preventing the metal wire 11 from falling out, an end of the metal wire 11 may be folded as depicted in FIG. 9.

In the coaxial cable 4 of the present technique, the yarns like the cotton yarns 26 are disposed along the longitudinal direction of the cable, resulting in that the inside of the coaxial cable 4 is filled with the yarns, thereby enabling the cross section of the coaxial cable 4 to be made substantially a circle shape. Therefore, it becomes easy to connect a circular connector (plug or jack) to the coaxial cable 4. Moreover, there is an advantage that in the case where the coaxial cable 4 is held in the hand, the elasticity that the surface is soft can be offered, and the good feeling can be obtained at the time of the folding operation.

Modified Change of First Embodiment

Figure 10:
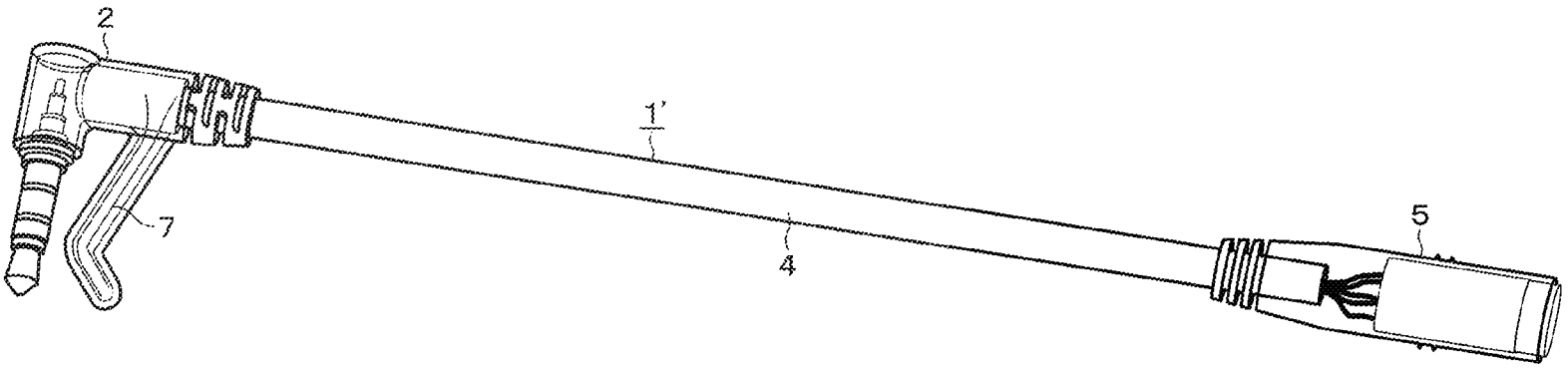
FIG. 10 is a perspective view for explaining a modified change of the first embodiment.

A description will now be given with respect to a modified change of the first embodiment described above with reference to FIG. 10 to FIG. 14. As depicted in FIG. 10, an earphone cable 1' with an antenna, as described above, has the construction in which the 4-pole plug 2 and the 4-pole jack 5 are connected to the both ends of the coaxial cable 4 having the shape-retaining function. The 4-pole plug 2, for example, has an L-letter shape. However, the 4-pole plug 2 may be of the straight type as described above. A detent 7 for preventing the rotation of the 4-pole plug 2 (coaxial cable 4) is provided integrally with the 4-pole plug 2. The detent 7 different in structure from the detent 3 described above is provided.

Figure 11:
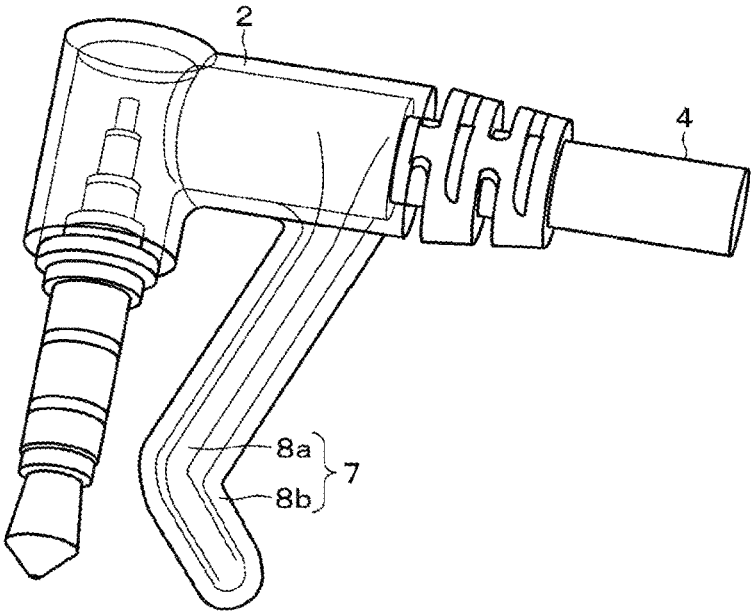
FIG. 11 is a perspective view for explaining a detent in the modified change of the first embodiment.

The detent 7, as depicted in FIG. 11 as well, has a shape in which the detent 7 protrudes from the plug base portion side so as to be close to the jack insertion portion of the plug end side, and the end portion of the detent 7 is bent in a direction of separating from the jack insertion portion. The detent 7 includes a resin, and has the elasticity of being freely accessed/separated to/from the jack insertion portion in the end thereof. A bending position of the detect 7 and the jack insertion portion may contact each other. As an interval between the bending position of the detent 7 and the jack insertion position is shorter, a force is increased in the case where the smartphone is clamped by the detent 7. In addition, as a thickness (width) of the detent 7 is larger, the clamping force of the detent 7 is increased. The detent 7 has the flexibility responding to the difference among thicknesses of the electronic apparatuses such as the smartphone. Moreover, the detent 7 can cope with an increase of the thickness caused by covering the smartphone with a cover. Furthermore, there is offered an effect of contributing not only to the detent, but also to the retainer of the plug.

In the case where the 4-pole plug 2 is molded, the detent 7 is also molded. In order to facilitate understanding, FIG. 10 and FIG. 11 depict schematically perspective views of the plug base portion side, a portion of the detent 7, and the like. At the time of manufacture of the 4-pole plug 2, as described above with reference to FIG. 4, the lines of the coaxial coaxial cable 4 are connected to respective electrodes protruding to the rear side of the jack insertion portion via the relay portion 13 through the ferrite bead FB having a function of cutting off the high frequency components. The relay portion 13, for example, is formed on a substrate or through the molding. The end portion of the cable, the lines, the electrodes, and the detent 7 (relay portion 13) which are connected to one another in such a manner are primary-molded using a resin, for example, PP (polypropylene). In FIG. 11, reference sign 8*a* indicates the detent obtained through the primary molding.

Moreover, the secondary molding of the double mold is carried out, so that the whole surface except for the jack insertion portion of the 4-pole plug 2 is coated with a material having the flexibility, for example, elastomer. The elastomer is a general term of the materials each having the rubber elasticity. In FIG. 11, the coating of the elastomer formed through the secondary molding is indicated by a reference sign 8*b*. The cover 6 of the detent 3 described above, and the coating 8*b* are similar to each other.

Figure 12:
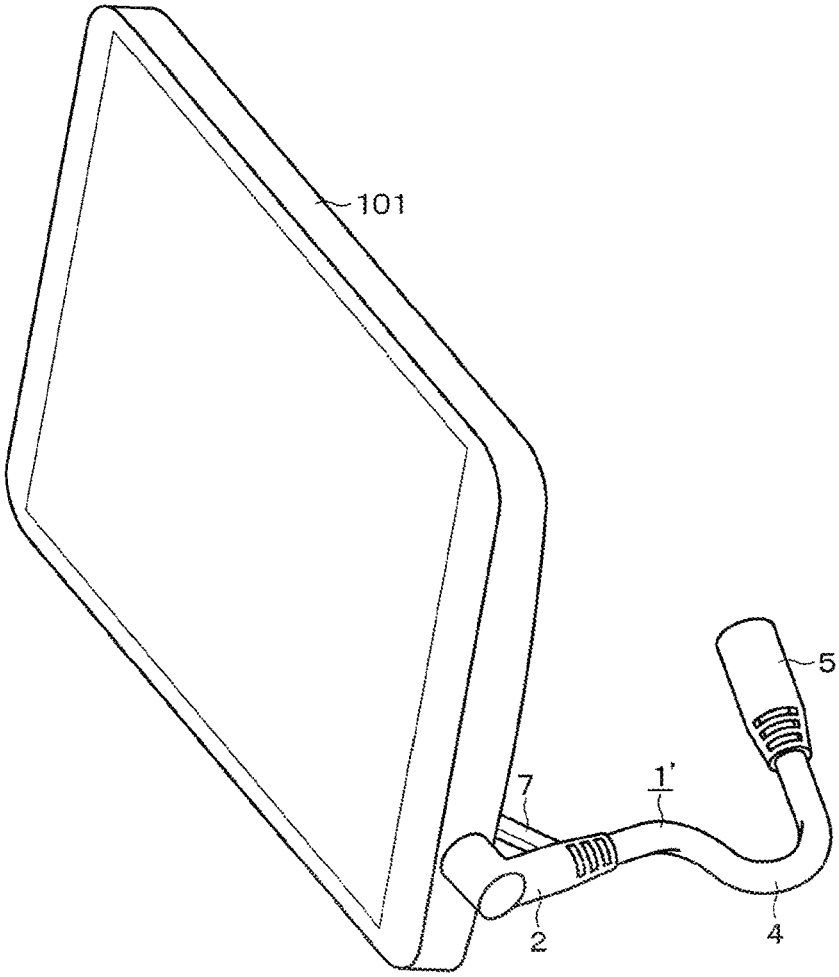
FIG. 12 is a perspective view used in a description of a use state in the modified change of the first embodiment.
Figure 13:
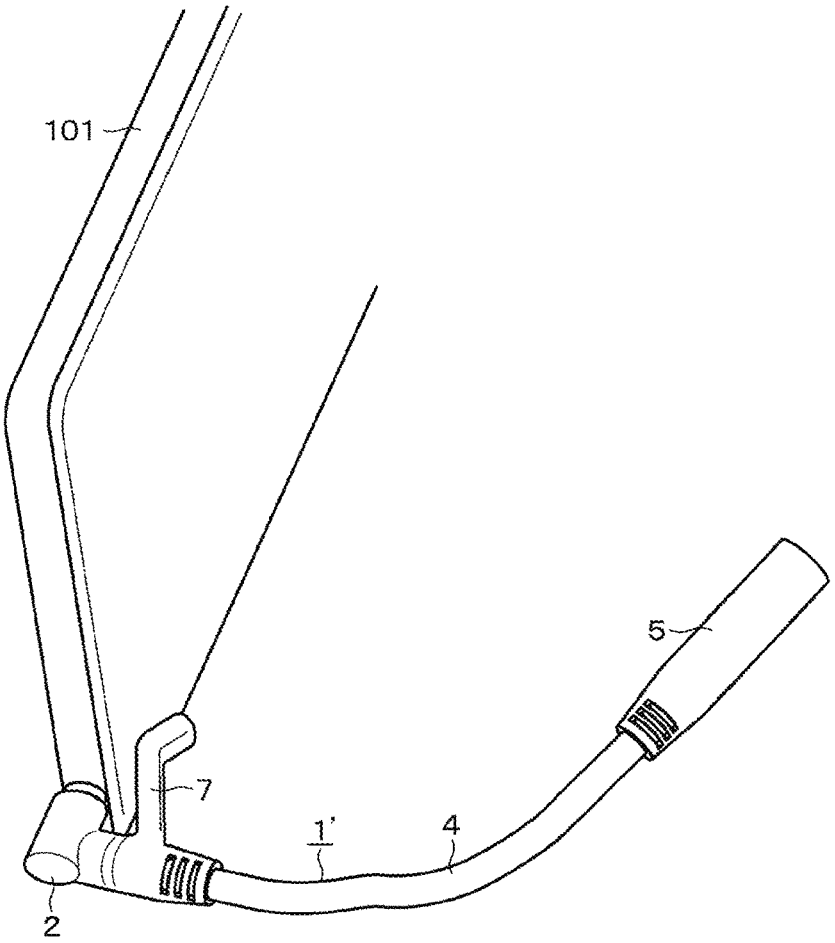
FIG. 13 is a perspective view used in a description of a use state in the modified change of the first embodiment.

The detent 7 has a function as a resin spring or a resin clip due to the elasticity thereof. In the case where the 4-pole plug 2 is connected to the jack (4-pole jack) for earphone connection of the portable apparatus having a flat shape, for example, the smartphone 101, the main body of the smartphone 101 can be clamped between the jack insertion portion and the detent 7. As depicted in FIG. 12 and FIG. 13, since the earphone cable 1' with the antenna has the shape-retaining function, when the earphone cable 1' with the antenna is connected to the smartphone 101, even if a stand or a holder as a separate body is not used, the smartphone 101 can be put upright at a suitable angle. An earphone cable (not depicted) is connected to the 4-pole jack 5, so that the sound is listened to through the earphone. Since the detent 7 is coated with the coating 8*b* including elastomer or the like, in the case where the detent 7 clamps the smartphone 101, the surface of the smartphone 101 can be prevented from being damaged. Moreover, the clamping state can be strengthened due to the non-slip effect of the coating 8*b*.

Figure 14:
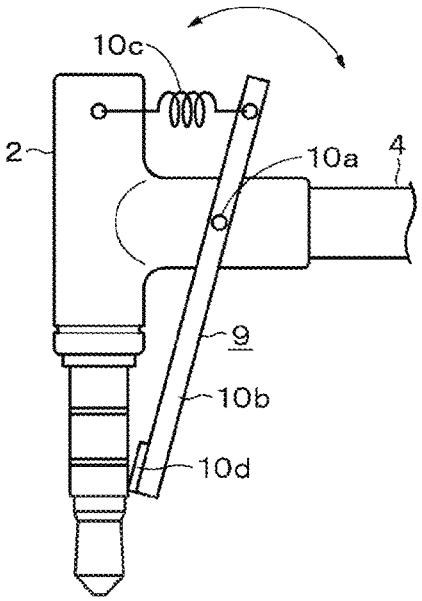
FIG. 14 is a front view for explaining another modified change of a detent.

FIG. 14 depicts another modified change of the detent. A detent 9 has a rod-shaped or plate-shaped clip 10*b* which is rotatably mounted to a fulcrum 10*a* provided in the 4-pole plug 2. A spring 10*c* is provided between one end of the clip 10*b* and the 4-pole plug 2. The clip 10*b* is given such an elastic force that an elastic piece 10*d* including elastomer or the like stuck to the other end of the clip 10*b* hits against the jack insertion portion by the spring 10*c*. A coil spring, a plate spring, a ring spring or the like can be used as the spring 10*c*, and in addition to the metal spring, a resin spring can also be used. A clip having the similar construction to that of the clip 10*b* may be provided on an opposite side surface of the 4-pole plug 2. Instead of the elastic piece 10*d*, an elastic cap may be provided.

In the case where the 4-pole plug 2 is inserted into the 4-pole jack of the electronic apparatus such as the smartphone, the 4-pole plug 2 (coaxial cable 4) can be prevented from being rotated by the detent 9. In addition, since the clip construction is adopted, similarly to the case of the detent 3, the detent 9 can be applied to the electronic apparatuses having the various thicknesses. Moreover, since the case of the electronic apparatus can be prevented from being damaged due to the elastic portion like the elastic piece 10*d*, a construction in which the double mode is omitted, and no coating is provided can be adopted.

2. Second Embodiment

"Use State"

Figure 15:
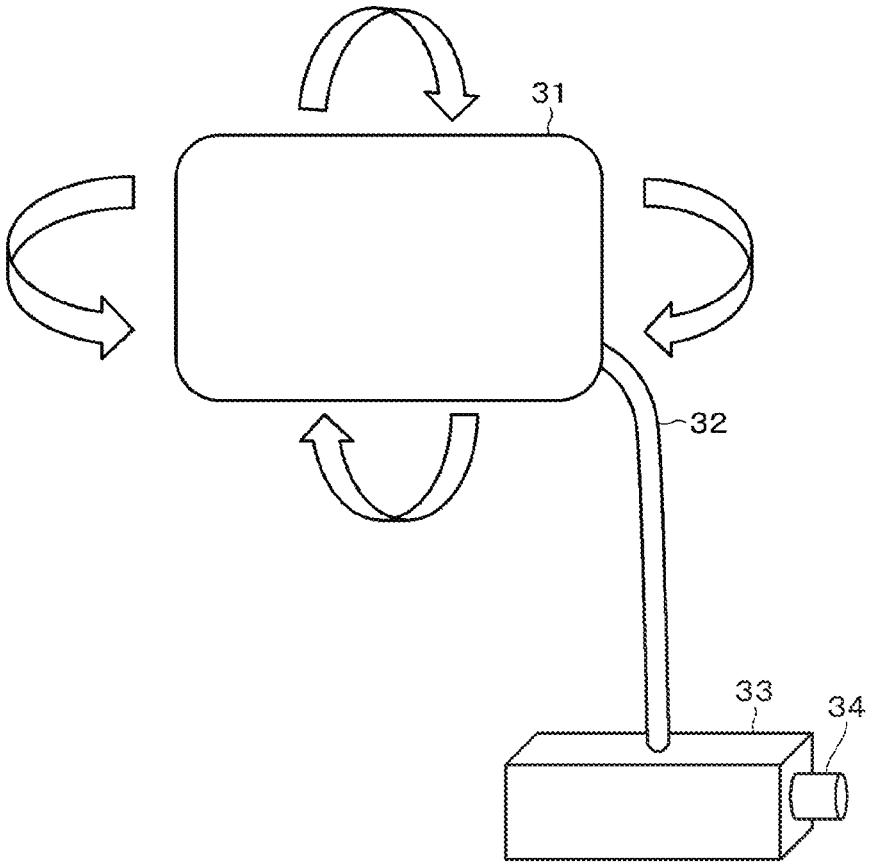
FIG. 15 is a perspective view used in a description of a use state of a second embodiment.

FIG. 15 depicts a use state of a second embodiment of the present technique. An indoor antenna element 31 is supplied by a coaxial cable stand 32. The coaxial cable stand 32 is a cable in which a coaxial cable is provided in the inside thereof. The coaxial cable stand 32 is erected from a base 33.

The base 33 is provided with a coaxial cable and a connector 34 for the connection to a television receiver. The present technique is applied to the coaxial cable stand 32, and the coaxial cable stand has the flexibility and the shape-retaining function. Therefore, a direction of the indoor antenna element 31 can be freely set.

Figure 16:
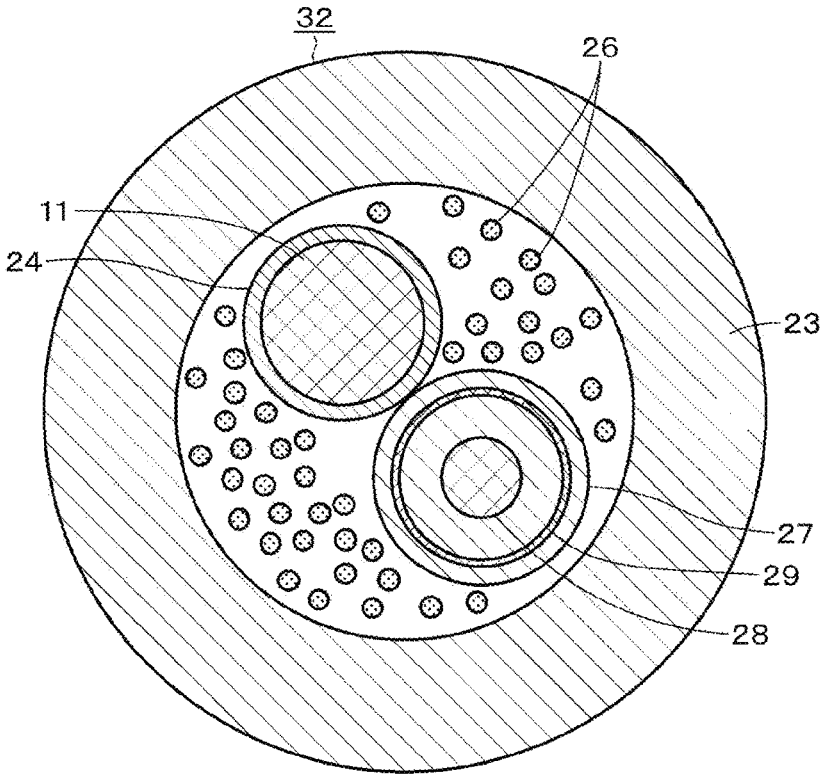
FIG. 16 is a cross-sectional view used in a description of a coaxial cable stand in the second embodiment of the present technique.

FIG. 16 is a cross-sectional view when the coaxial cable stand 32 is cut vertically with respect to a longitudinal direction of the coaxial cable stand 32. As compared with the coaxial cable 4 described above, the coaxial cable stand 32 is different from the coaxial cable 4 described above in that the line for the audio signal transmission is not provided. Therefore, a metal wire 11 coated with a resin 24, a cotton yarn 26, and a coaxial cable 27 are coated with an outer insulating coating 23. The coaxial cable 27 has a core line 28 and a shielded wire 29.

Similarly to the first embodiment, the metal wire 11 has such flexibility as to be able to be freely folded, and has the shape-retaining property such that the metal wire 11 functions as the stand of the indoor antenna element 31. The metal wire 11 is a wire rod which, for example, includes copper, iron, stainless, or a combination thereof, and has a diameter of 0.5 mm or more. The diameter and material quality of the metal wire 11 are suitably set in consideration of a weight of the indoor antenna element 31 supported thereby.

Figure 17:
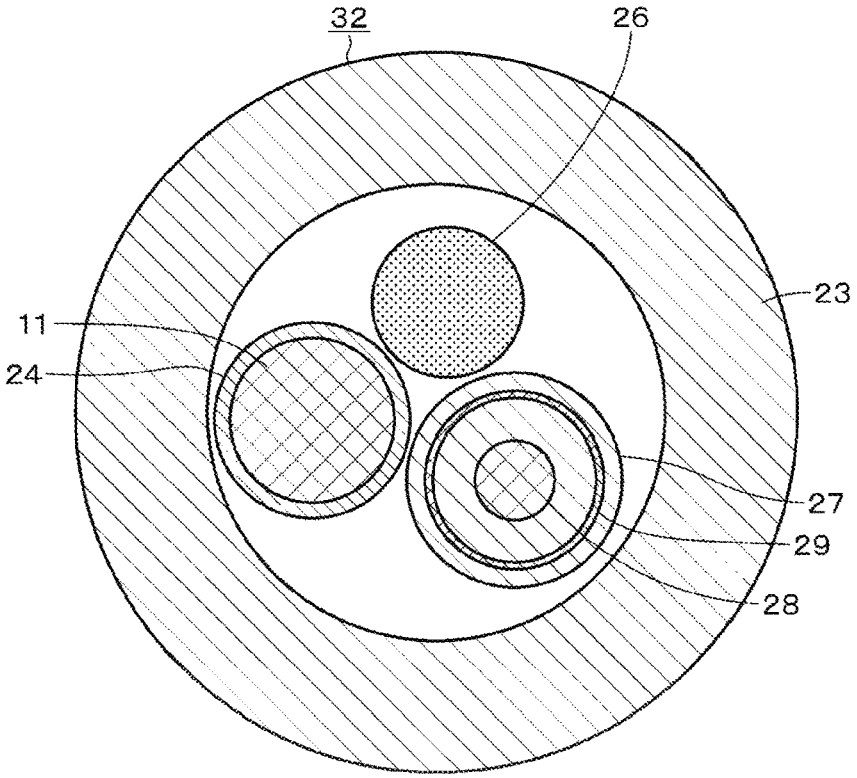
FIG. 17 is a cross-sectional view used in a description at the time of manufacture of the coaxial cable stand in the second embodiment of the present technique.

In addition to the cotton yarn 26, an insulating yarn such as a yarn of a chemical fiber including aramid, nylon or rayon may be used. The cotton yarn 26 is advantageous in terms of cost, easy to be available, and easy in processing such as cutting. Since the yarns have a form of twisted yarns obtained by twisting a plurality of yarns, at the time of the manufacture, as depicted in FIG. 17, the yarns are present in a state in which a plurality of yarns are bundled by the inner insulating coating 22. After the manufacture, or after the coaxial cable stand 32 is used for a certain period of time, the cotton yarns 26 get loose in the inside to become a state in which the cotton yarns 26 are present in a substantially uniformly dispersed manner as depicted in FIG. 16. As far as the twisted yarns, the twisted yarns obtained by bundling the approximately 2 to 4 yarns twisted, or one twisted yarn obtained by bundling more yarns can be used. The cotton yarns 26 having a length substantially equal to a total length of the coaxial cable stand 32 can be used. However, the cotton yarn 26 which is divided into parts each having a shorter length may be used. For the retainer, the end of the metal wire 11 may be folded.

Using the cable stand 32 results in that there is no need for separately using the coaxial cable for connection, and the stand. Moreover, in the coaxial cable stand 32 of the present technique, the yarns like the cotton yarns 26 are disposed along the longitudinal direction of the cable, resulting in that the inside of the coaxial cable stand 32 is filled with the yarns. Moreover, there is an advantage that in the case where the coaxial cable stand 32 is held in the hand, the elasticity that the surface is soft can be offered, and the good feeling can be obtained at the time of the folding operation.

3. Third Embodiment

Figure 18:
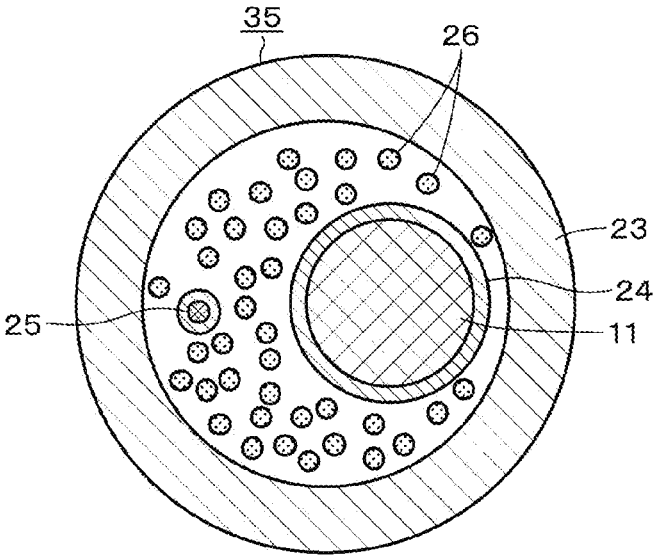
FIG. 18 is a cross-sectional view used in a description of a cable stand in a third embodiment of the present technique.

As depicted in FIG. 18, a third embodiment is a cable stand 35 in which instead of the coaxial cable 27 in the second embodiment, a line 25 for signal transmission or power source supply is provided. The number of lines 25 is set to the number responding to the use application. For example, if the line 25 is an earphone cable and has a jack for connection, then, the cable stand 35 can be used as a stand-cum-earphone cable for a portable type digital audio player.

4. Fourth Embodiment

Figure 19:
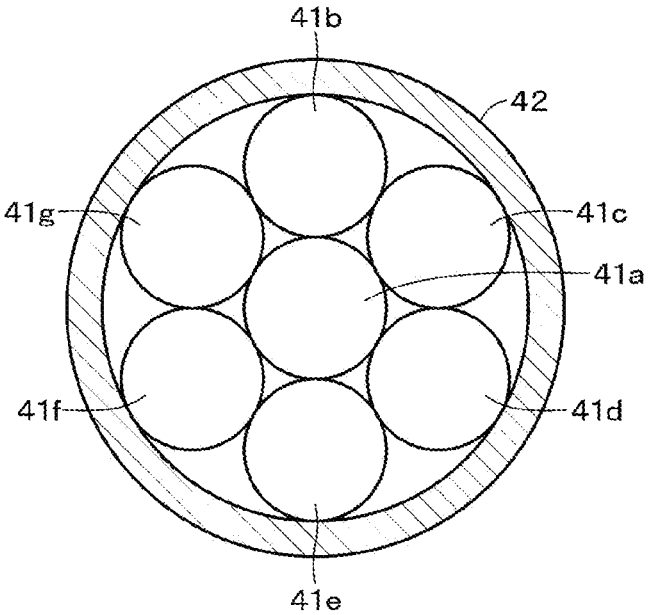
FIG. 19 is a cross-sectional view used in a description of an example of a bundled line used in a cable in a fourth embodiment of the present technique.
Figure 20:
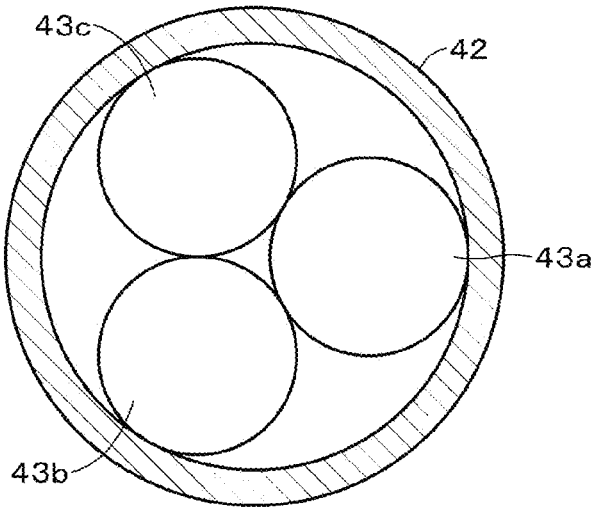
FIG. 20 is a cross-sectional view used in a description of another example of the bundled line.

In the coaxial cable 4 in the first, second and third embodiments described above, for the purpose of having the rigidity necessary for the shape retaining, one metal wire 11 having a predetermined thickness is used. In a fourth embodiment, instead of the metal wire 11, a line obtained by bundling a plurality of metal wires each having a smaller wire diameter (referred to as a bundled line) is used. Although the bundled line has the construction of the twisted wire, the twisting is not essential, and a line obtained by simply bundling the metal wires with a coating may also be available. As an example, as depicted in FIG. 19, a bundled line is used which is obtained by bundling seven thin metal wire rods 41*a* to 41*g* into one line and coating the one line with an insulating coating film 42. As another example, as depicted in FIG. 20, a bundled line is used which is obtained by bundling three thin metal wire rods 43*a*, 43*b* and 43*c* into one line and coating the one line with the insulating coating film 42. The insulating coating film 42, for example, includes polypropylene. A bundled line may be used which is obtained by bundling other number of wire rods into one line. It should be noted that annealed copper, for example, is used as the material of the metal wire 11 and the wire rod of the bundled line. However, in addition to the annealed copper, a metal having the similar physical property to that of the annealed copper may be used.

Figure 21:
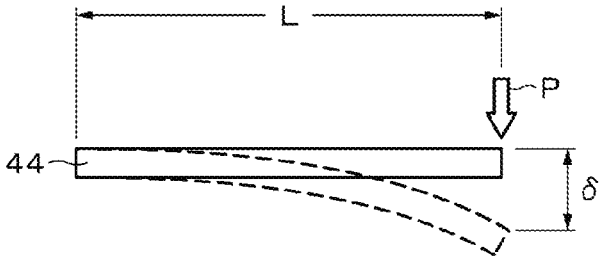
FIG. 21 is a schematic diagram used in a description of the fourth embodiment of the present technique.

Such a bundled line, similarly to the metal wire 11, has the rigidity necessary for supporting the electronic apparatus such as the smartphone, and can also have the performance superior to the metal wire 11 in the bending characteristics for the folding. First, the rigidity will be described. There is used a testing apparatus for the rigidity as schematically depicted in FIG. 21. Deflection δ of the other end when one end of a wire rod 44 having a span L is fixed and a predetermined load P is applied to the other end is measured. Table 3 indicates results of measurement of the deflection δ in the case where the span L=30 mm, and the load P=1 N. The measurement was carried out with respect to a single wire having D (wire diameter)=0.5 m, a single wire having D=1.0 m, a bundled line obtained by bundling three single wires each having D=0.5 m, a bundled line obtained by bundling three single wires each having D=0.6 m, a bundled line obtained by bundling three single wires each having D=0.517 m, and a bundled line obtained by bundling seven single wires each having D=0.326 m as the wire rod 44.

TABLE 3

| L (span) [mm] | P (load) [N] | D (wire shape) [mm] | δ (deflection) [mm] | Remark |
|---|---|---|---|---|
| 30 | 1 | 0.5 | 27.57 | single wire |
| 30 | 1 | 1 | 1.72 | single wire, this strength is set as standard |
| 30 | 1 | 0.5 | 2.58 | bundled line of 3 wires |
| 30 | 1 | 0.6 | 1.23 | bundled line of 3 wires |
| 30 | 1 | 0.517 | 2.26 | bundled line of 3 wires |
| 30 | 1 | 0.326 | 2.87 | bundled line of 7 wires |

As an example, the deflection δ=1.72 mm of the single wire having L=30 mm and D=1 mm is set as the standard of the rigidity (strength). The standard means such a rigidity that the smartphone having a predetermined weight can be supported. From the measurement results of Table 3, it is understood that the bundled lines other than the single wire having D=0.5 mm substantially have the necessary rigidity. In the case where the numbers of wires in the bundled lines are equal to one another, as the wire diameter is larger, the strength is higher. In the comparison with the metal wire 11 as the single wire, it is necessary to pay attention to the rigidity of the bundled lines the wire diameters of which are substantially equal to one another as a whole.

In the case where the number of wires is seven (refer to FIG. 19), when the wire rod having D=0.326 mm is used, the wire diameter of the bundled line becomes approximately 1 mm. That is, when the thickness of the insulating coating film 42 is 0.22 mm, the overall wire diameter OD becomes (0.22×2+0.326×3=1.418 mm). As indicated in Table 3, the deflection of such a bundled line becomes (δ=2.87 mm), and thus the rigidity close to the standard rigidity is obtained.

In the case where the number of wires is three (refer to FIG. 20), when the wire rod having D=0.517 mm is used, the wire diameter of the bundled line becomes approximately 1 mm. That is, when the thickness of the insulating coating film 42 is 0.2 mm, the overall wire diameter OD becomes (0.2×2+0.517×2=1.434 mm). As depicted in Table 3, the deflection of such a bundled line becomes (δ=2.26 mm), and thus the rigidity close to the standard rigidity is obtained.

Figure 22:
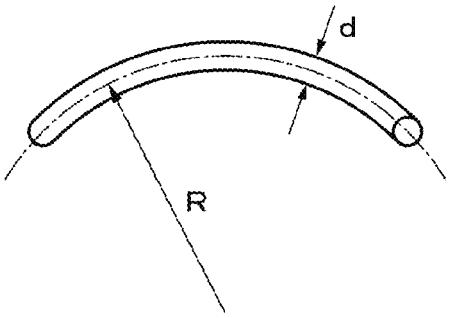
FIG. 22 is a schematic diagram used in a description of the fourth embodiment of the present technique.

Next, the bending characteristics of the bundled line will now be described. As depicted in FIG. 22, in the case where the single wire is bent, the single wire is expanded from the center to the outside, and the inner side of the single wire is contracted. A maximum value of a strain is expressed by Expression (1):

$$\max(\mathrm{abs}(\varepsilon)=d/(2*R) \quad (1)$$

where

ε: strain d: outer diameter of single wire (m)

R: curvature radius of bending (m)

abs(x): absolute value of x max(x): maximum value of x

That is, Expression (1) represents a maximum value of strain amplitude generated in the single wire.

In the case where the single wire is repetitively bent, the strain expressed by Expression (1) is given to the outside and the inside of the single wire. Once a crack due to the fatigue is generated in the outside, the break is generated due to the stress concentration without stopping. Therefore, it is possible to consider that the number of break repetitions in a position where the single wire suffers the maximum strain amplitude becomes the number of break repetitions of the single wire itself. In a word, a relation expressed by following Expression (2) is obtained.

$$N=a*(R/d)^2 \quad (2)$$

where

N: the number of break repetitions of single wire (cycle)

R: curvature radius of bending (m)

d: outer diameter of single wire (m)

a: constant decided by material

Actually, the result of the experiment also agrees with Expression (2), and in case of the normal annealed copper wire, a is approximately 1.4.

From Expression (2), it is understood that the fatigue strength of the single wire is proportional to the square of the minimum curvature radius of the bending, and is inversely proportional to the square of the outer diameter of the single wire. In the case where the repetitive bending at the time of use is taken into consideration, it can be determined that when the wire rod having a smaller diameter is used, the single wire is harder to break, and this is effective. Table 4 indicates a theoretical value and measured value of the number of bendings in case of the single wire.

TABLE 4

| a constant | d [mm] | R [mm] | N number of bendings | measured value number of bendings |
|---|---|---|---|---|
| 1.4 | 0.95 | 5 | 39 | 56 |
| 1.4 | 0.95 | 6 | 56 | |

In case where the number of wires is seven (refer to FIG. 19), the wire rod having d=0.326 mm is used, and if the insulating coating film 42 is excluded, then, the wire diameter becomes 0.978 mm. Table 4 indicates the results in which the numbers of bendings when the curvature radius R (mm) is 5, 7, 8, 10, 15, 20 and 25 are each obtained. In addition, in case where the number of wires is three (refer to FIG. 20), the wire rod having d=0.517 mm is used, and if the insulating coating film 42 is excluded, then, the wire diameter becomes 1.034 mm. Table 6 indicates the results in which the numbers of bendings when the curvature radius R (mm) is 5, 7, 8, 10, 15, 20 and 25 are each obtained.

TABLE 5

| a constant | d [mm] | R [mm] | N number of bendings |
|---|---|---|---|
| 1.4 | 0.326 | 5 | 329 |
| 1.4 | 0.326 | 7 | 645 |
| 1.4 | 0.326 | 8 | 843 |
| 1.4 | 0.326 | 10 | 1317 |
| 1.4 | 0.326 | 15 | 2964 |
| 1.4 | 0.326 | 20 | 5269 |
| 1.4 | 0.326 | 25 | 8233 |

TABLE 6

| a constant | d [mm] | R [mm] | N number of bendings |
|---|---|---|---|
| 1.4 | 0.517 | 5 | 131 |
| 1.4 | 0.517 | 7 | 257 |
| 1.4 | 0.517 | 8 | 335 |
| 1.4 | 0.517 | 10 | 524 |
| 1.4 | 0.517 | 15 | 1178 |
| 1.4 | 0.517 | 20 | 2095 |
| 1.4 | 0.517 | 25 | 3274 |

As understood when Table 4 and Table 5 are compared with each other, in the case of R=5 mm, the bundled line of seven wires exhibits (N=329) and thus has the characteristics of being able to bear many more number of bendings as compared with (N=39 (theoretical value), N=56 (measured value)) exhibited by the single wire. As understood when Table 4 and Table 6 are compared with each other, in the case of R=5 mm, the bundled line of three wires exhibits (N=131) and thus has the characteristics of being able to bear many more number of bendings as compared with (N=39 (theoretical value), N=56 (measured value)) exhibited by the single wire.

The fourth embodiment uses the bundled line which is obtained by bundling a plurality of thin wire rods into one line in such a manner, resulting in that the bundled line can enhance the bending characteristics while having the rigidity similar to that of the single metal wire.

5. Fifth Embodiment

Figure 23:
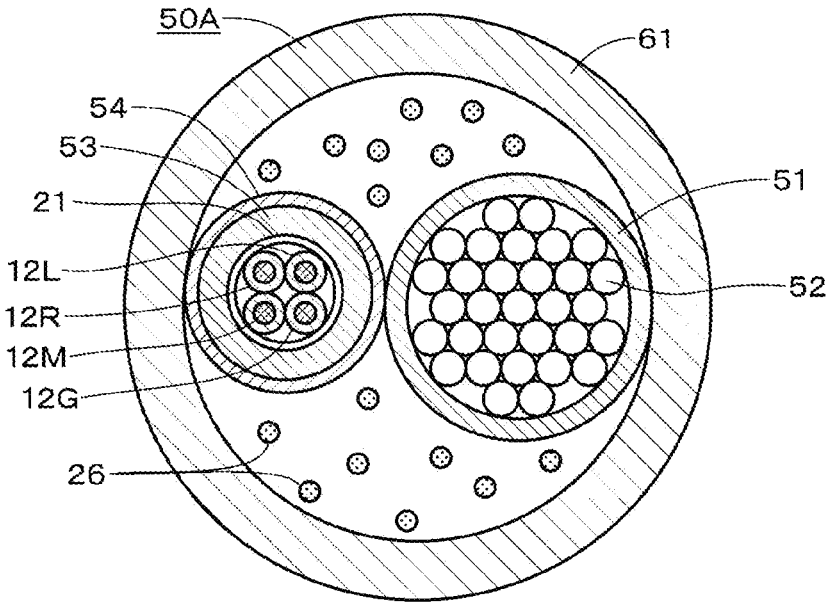
FIG. 23 is a cross-sectional view used in a description of a fifth embodiment of the present technique.

A fifth embodiment, similarly to the first embodiment, is a cable which can be applied to the earphone cable with an antenna. In the first embodiment, the shielded wire 14 provided in the coaxial cable 4 is made to function as the antenna. On the other hand, a cable 50A in the fifth embodiment adopts a construction in which no shielded wire is provided. Thus, as depicted in FIG. 23, a bundled line 51 which is obtained by bundling a plurality of metal wires 52 and coating the bundled metal wires 52 with a coating film material is given the function as an antenna. The coating material is a metal foil of aluminum or the like, a resin, a resin mixed with a magnetic material such as ferrite, paper or the like. It should be noted that the bundled line 51 may be a twisted wire or may be a wire not twisted. In addition, the number of metal wires 52 of the bundled line 51 is suitably set.

Moreover, the bundled line 51 has the rigidity enough to support the electronic apparatus such as the smartphone. Therefore, as compared with the coaxial cable 4 (FIG. 7) of the first embodiment, not only the shielded wire 14, but also the metal wire 11 can be omitted. That is, the members coated with an insulating coating film 61 of the cable 50A are the signal line 21, the bundled line 51, and the cotton yarn 26. The signal line 21 has the line 12L for the audio signal transmission of the L-channel, the line 12R for the audio signal transmission of the R-channel, the ground line 12G, and the microphone cable 12M. These transmission lines 12L, 12R, 12G, and 12M are each coated with an insulating coating material (such as paper or polyurethane).

Moreover, four lines for audio signal transmission are bundled by a coating material. The coating material is a metal foil including aluminum or the like, a resin, a resin mixed with a magnetic material such as ferrite, paper or the like. Furthermore, the peripheral surface of the coating material of the signal line 21 is coated with a synthetic resin 53 mixed with powder of ferrite, and is coated with an insulating coating film 54. The isolation between the signal line 21 and the bundled line 51 (antenna cable) can be secured by the synthetic resin 53. As a result, the property as the antenna of the bundled line 51 can be made satisfactory.

Since the cable 50A of such a fifth embodiment has none of the shielded wire 14 and the metal wire 11, the wire diameter of the cable can be reduced as compared with the coaxial cable 4 of the first embodiment. If in the construction of FIG. 7, for the purpose of slenderizing the cable, the outermost coating is thinned, then, it is feared that the wrinkles are generated while the cable is used. Since the fifth embodiment has no shielded wire 14, the thin cable can be obtained.

Figure 24:
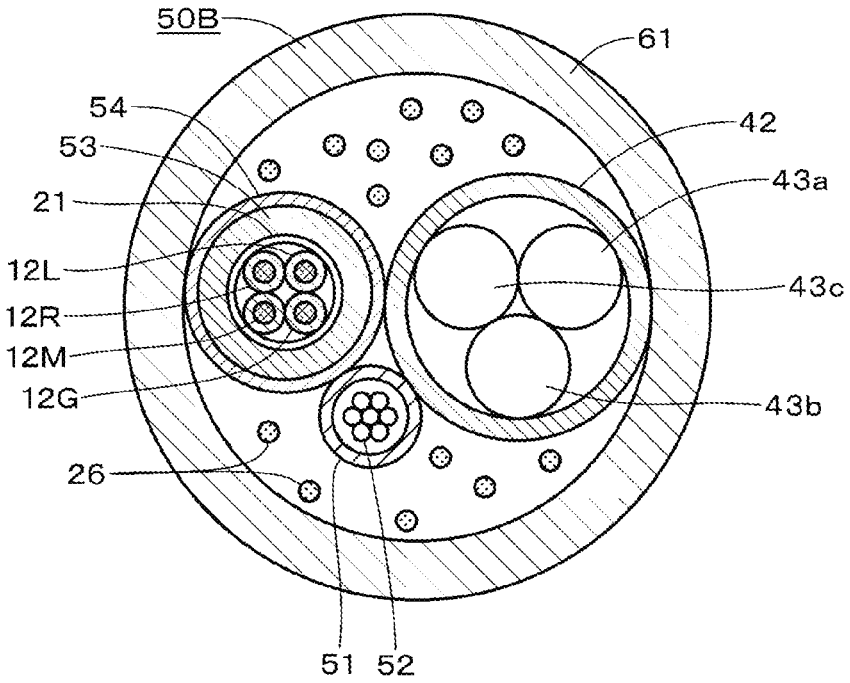
FIG. 24 is a cross-sectional view used in a description of a modified change of the fifth embodiment of the present technique.

FIG. 24 depicts a cable 50B having another constitution of the fifth embodiment. The number of metal wires 52 of the bundled line 51 having the antenna function is reduced as compared with the construction of FIG. 23. In this case, for the purpose of compensating for the shape-retaining force decreased by the reduction, there is used a bundled line which is obtained by bundling three thin metal wire rods 41*a*, 41*b* and 41*c* into one line and coating the one line with an insulating coating film 42. The insulating coating film 42, for example, includes polypropylene. The bundled line for the shape retention is similar to that of the fourth embodiment described above. The number of wire rods is by no means limited to three. The annealed copper, for example, is used as the material of the wire rod of the bundled line. However, in addition to the annealed copper, a metal having the similar physical property may be used.

Figure 25:
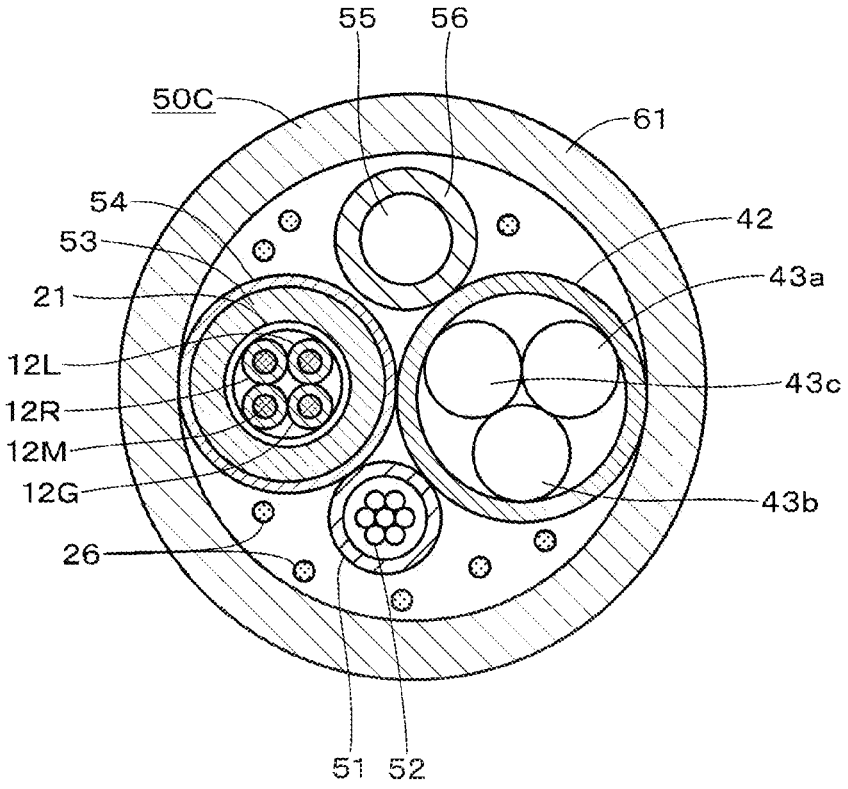
FIG. 25 is a cross-sectional view used in a description of another modified change of the fifth embodiment of the present technique.

For the shape retention, instead of the bundled line, single metal wire may be used. Moreover, as depicted in FIG. 25, in addition to the bundled line which is obtained by bundling the wire rods 41*a*, 41*b* and 41*c* into one line and coating the one line with the insulating coating film 42, a wire rod which is obtained by coating one metal wire 55 with an insulating coating film 56 may be used. With the construction of FIG. 25, the rigidity of the shape retention can be more increased. Even with the construction depicted in FIG. 24 or FIG. 25, the wire diameter of the cable can be thinned.

6. Modified Changes

Although the embodiments of the present technique have been concretely described so far, the present technique is by no means limited to the embodiments described above, and various kinds of modified changes based on the technical idea of the present technique can be made. For example, for forming the detent, not only the double mold, but other molding methods may also be used. In addition, the constituents, the methods, the processes, the shapes, the materials, the numerical values, and the like which are given in the embodiments described above are merely exemplifications, and thus constitutions, methods, processes, shapes, materials, numerical values, and the like different from those may be used as needed.

It should be noted that the present technique can adopt the following constitutions.

(1)

A cable, including:

a line for signal transmission or power source supply;

a first metal wire having flexibility and a shape-retaining property;

a plurality of yarns extending substantially in a same direction as that of the first metal wire; and a coating material for coating the line, the first metal wire, and the plurality of yarns.

(2)

The cable according to (1), in which the plurality of yarns includes at least one of a cotton yarn and a chemical fiber.

(3)

The cable according to (1), in which the first metal wire is coated with an insulating coating film.

(4)

The cable according to (1), in which a connection unit for connection to an electronic apparatus is provided in at least one end of the cable.

(5)

The cable according to (4), in which the connection unit has a detent.

(6)

The cable according to (5), in which the detent includes a resin or a metal and is formed in a circumference of the connection unit.

(7)

The cable according to (6), in which the detent has elasticity so as to be freely accessed and separated to and from an insertion portion of the connection unit.

(8)

The cable according to (7), in which the detent includes a resin having elasticity, and a surface of the detent is coated with elastomer.

(9)

The cable according to (1), in which the first metal wire is obtained by bundling a plurality of metal wires.

(10)

The cable according to (1), in which the cable includes an antenna.

(11)

The cable according to (1), in which the first metal wire is an antenna.

(12)

The cable according to (1), further including:

a second metal wire different from the first metal wire, in which a circumference of the second metal wire is coated with an insulating coating film.

(13)

The cable according to (12), in which the second metal wire is an antenna.

(14)

The cable according to (1), in which a shielded wire is formed in a circumference of the line, the first metal wire, and the plurality of yarns, thereby constructing a coaxial cable.

(15)

The cable according to (14), in which the shielded wire is an antenna.

(16)

The cable according to (1), in which the line for supply of a signal or a power source is an audio signal transmission line.

(17)

The cable according to (1), in which the line for supply of a signal or a power source is a USB cable, or an HDMI (registered trademark) cable.

1, 1' . . . Earphone cable with antenna
2, 112 . . . 4-pole plug
3, 7, 9 . . . Detent
5, 102 . . . 4-pole jack
11 . . . Metal wire
12L, 12R, 12G, 12M . . . Audio transmission line
14 . . . Shielded wire
21 . . . Signal line
24 . . . Insulating coating
25 . . . Signal cable
26 . . . Cotton yarn
27 . . . Coaxial cable
31 . . . Indoor antenna element
35 . . . Cable stand
41*a* to 41*g*, 43*a* to 43*c*, 44 . . . Wire rod
42 . . . Insulating coating film
50A, 50B, 50C . . . Cable
51 . . . Bundled line having antenna function
111 . . . Earphone portion

The invention claimed is:

1. A cable, comprising:

a line for one of signal transmission or power source supply;

a first metal wire having flexibility and a shape-retaining property;

a plurality of yarns that extends substantially in a same direction as the first metal wire;

a first coating material that coats the line, the first metal wire, and the plurality of yarns; and a shielded wire around an outer circumference of the first coating material.

2. The cable according to claim 1, wherein the plurality of yarns includes at least one of a cotton yarn or a chemical fiber.

3. The cable according to claim 1, wherein the first metal wire is coated with an insulating coating film.

4. The cable according to claim 1, further comprising a connection unit for connection to an electronic apparatus in at least one end of the cable.

5. The cable according to claim 4, wherein the connection unit has a detent.

6. The cable according to claim 5, wherein the detent includes one of a resin or a metal, and the detent is in a circumference of the connection unit.

7. The cable according to claim 6, wherein the detent has elasticity so as to be freely accessed and separated to or from an insertion portion of the connection unit.

8. The cable according to claim 5, wherein the detent includes a resin having elasticity, and a surface of the detent is coated with elastomer.

9. The cable according to claim 1, wherein the first metal wire includes a plurality of bundled metal wires.

10. The cable according to claim 1, further comprising an antenna.

11. The cable according to claim 1, wherein the first metal wire is an antenna.

12. The cable according to claim 1, further comprising a second metal wire different from the first metal wire, wherein a circumference of the second metal wire is coated with an insulating coating film.

13. The cable according to claim 12, wherein the second metal wire is an antenna.

14. The cable according to claim 1, wherein the shielded wire is in a circumference of the line, the first metal wire, and the plurality of yarns, and the shielded wire, the line, the first metal wire, and the plurality of yarns constitute a coaxial cable.

15. The cable according to claim 14, wherein the shielded wire is an antenna.

16. The cable according to claim 1, wherein the line for supply of a signal or a power source is an audio signal transmission line.

17. The cable according to claim 1, wherein the line for supply of a signal or a power source is a universal serial bus (USB) cable, or a high-definition multimedia interface (HDMI) cable.

18. The cable according to claim 1, further comprising a second coating material that coats an outer circumference of the shielded wire.

19. A cable, comprising:

a line for one of signal transmission or power source supply;

a first metal wire having flexibility and a shape-retaining property;

a plurality of yarns that extends substantially in a same direction as that of the first metal wire;

a coating material that coats the line, the first metal wire, and the plurality of yarns; and a connection unit in at least one end of the cable, wherein the connection unit is for connection to an electronic apparatus, the connection unit that includes a detent, the detent includes one of a resin or a metal, the detent is formed in a circumference of the connection unit, and the detent has elasticity so as to be freely accessed and separated to and from an insertion portion of the connection unit.

* * * * *